United States Patent [19]

Serizawa

[11] Patent Number: 4,976,436

[45] Date of Patent: Dec. 11, 1990

[54] GOLF PUTTER INCLUDING BALL RETRIEVEL MEANS

[75] Inventor: Seijiro Serizawa, Amagasaki, Japan

[73] Assignee: Laurel Kaihatsu Co., Ltd., Tokyo, Japan

[21] Appl. No.: 425,358

[22] Filed: Oct. 23, 1989

Related U.S. Application Data

[63] Continuation of Ser. No. 154,352, Feb. 10, 1988, abandoned.

[30] Foreign Application Priority Data

Dec. 21, 1987 [JP] Japan ..... 52-323303

[51] Int. Cl.[5] ..... A63B 53/04

[52] U.S. Cl. ..... 273/162 E; 294/19.2

[58] Field of Search ..... 294/19.2; 273/167 E, 273/186 A, 183 D, 164, 162 E

[56] References Cited

U.S. PATENT DOCUMENTS

| | | | |
|---|---|---|---|
| 1,960,110 | 5/1934 | Iles | 273/162 E |
| 2,465,124 | 3/1949 | Quattrin | 273/186 A |
| 3,300,241 | 1/1967 | Eberwein et al. | 273/162 E |
| 3,374,027 | 3/1968 | Jacobs | 273/162 E |
| 3,632,112 | 1/1972 | Jacobs | 273/162 E |
| 3,708,172 | 1/1973 | Rango | 273/162 E |
| 3,841,639 | 10/1974 | Werner | 273/162 E |
| 4,201,384 | 5/1980 | Barber | 273/183 C |
| 4,580,784 | 4/1986 | Brill | 273/162 E |

FOREIGN PATENT DOCUMENTS

| | | | |
|---|---|---|---|
| 356155 | 9/1931 | United Kingdom | 273/162 E |

*Primary Examiner*—George J. Marlo

*Attorney, Agent, or Firm*—Oblon, Spivak, McClelland, Maier & Neustadt

[57] ABSTRACT

A putter for enabling picking up a ball within a hole in a standing posture of a golfer without stretching an arm while bending the body merely by slightly pushing the ball downward with the head of the putter substantially in the shape of a ring constituting a circular hollow portion in the middle thereof so as to maintain the ball therein and preventing the ball from dropping on account of the elasticity of the surface of the ball and the friction between the ball and an inner peripheral edge of the circular hollow portion of the head abutting the elastic surface of the ball.

4 Claims, 2 Drawing Sheets

GOLF PUTTER INCLUDING BALL RETRIEVEL MEANS

This application is a continuation of application Ser. No. 154,352, filed on Feb. 10, 1988, now abandoned.

BACKGROUND OF THE INVENTION

1. Field of the Invention

The present invention relates to a putter used for golf; and more particularly relates to an improved putter enabling picking up of a ball within a hole in a standing posture of a golfer without bending the body and while stretching an arm of the golfer.

2. Description of the Prior Art

In order to pick up a ball within a hole, such forced posture as bending the body while stretching an arm is required in order to pick up the ball within the hole with the fingers of the golfer.

On the other hand, there has not hitherto existed with a putter enabling picking up the ball within the hole in standing posture of a golfer by employing a putter itself used for golf play without assuming the aforementioned forced posture. As a putter somewhat similar to the putter as above described, a putter as illustrated in FIG. 4 and FIG. 5 may sometimes be found. However, as is obvious therefrom, said conventional putter is provided with a lateral recess in a concave shape along the back face of the head thereof and further both ends thereof are curled upward so as to pick up a ball thereon. However, such a conventional putter as above has a configuration of a lateral recess along the back face of the head; and accordingly in order to pick the ball within the hole with a diameter (108 mm) and a depth (100 mm and more), it is considerably difficult to pick up the same by employing a putter in view of the length of the face thereof stretching in the lateral direction and furthermore even when the ball can be picked up onto the recess, the ball thus picked up has no stability in said recess; and therefore practical skill is required to attain an expected object; and thus serious problems exist. Furthermore, regarding the bad influence on the body ascribable to such forced posture as bending the body while stretching an arm downward, such is recognized in medical science.

SUMMARY OF THE INVENTION

The present invention seeks to overcome the aforementioned conventional defect by providing an improved putter enabling one to pick up a ball within a hole surely and easily without assuming a forced posture.

It is an object of the present invention to provide an improved putter enabling picking up a ball within a hole surely and easily in a standing posture of a golfer with a putter employed in golf play by utilizing a head of said putter. An additional object of the present invention is to provide a putter enabling putting the ball at the center of a flat faced portion of the head so as to employ a conventional putter having a laterally extending configuration.

The aforementioned objects can be attained by a putter comprising one end portion of a shaft 1 firmly secured orthogonally to a head B made of stainless steel or other materials similar thereto, said head B being substantially in the shape of a ring forming arcs extending from both ends of a flat faced portion 3 so as to constitute a circular hollow portion with a diameter somewhat smaller than that of a golf ball and a thickened wall portion 4 extending substantially two-thirds of the vertical height of an inner peripheral surface 5 of said circular hollow portion 2 from the upper portion to the lower portion along said surface 5 and further integrally formed therewith.

BRIEF DESCRIPTION OF THE DRAWINGS:

Other and further objects of the present invention will become apparent from the following detailed description with reference to the drawings which, by way of example, illustrate preferred embodiments of the invention, in which.

Figure 1:
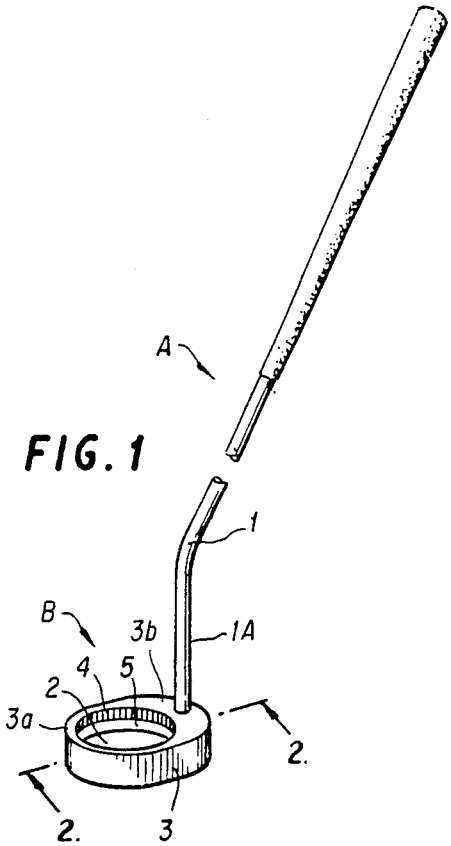
FIG. 1 is a perspective view of a putter according to the present invention.
Figure 2:
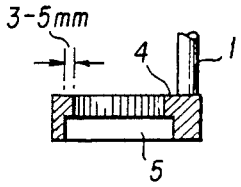
FIG. 2 is a sectional view taken along line X—X in FIG. 1.

DESCRIPTION OF THE PREFERRED EMBODIMENTS:

The present invention will be described in detail with reference to the drawings. It should be understood that the illustrated embodiment is susceptible to modification and change without departing from the spirit of the invention. The same numeral is given to the same part in the drawings.

FIG. 1 is a perspective view of a putter according to the invention. In FIG. 1, A is a putter and B is a head of said putter. One end of portion 1A of a shaft 1 is secured orthogonally to the surface of said head B for a distance generally corresponding to a depth of a putting cup as illustrated therein. The length of the end portion 1A of the shaft 1 is preferably 7–9 cm taking into consideration the depth (100 mm and more) of a hole 8 so as to easily push a ball 6 within the hole slightly downward by utilizing the weight of the head B.

The head B made of steel materials, preferably stainless steel, has a configuration of a flat faced portion 3 for putting a ball and arcs 3*a*, 3*b*, extending from both ends of the portion 3 to constitute the head in the shape of a ring with a circular hollow portion 2 in the middle of the head. Of course, the ends may be formed to have a configuration substantially orthogonal to the portion 3 without forming the arcs at both ends thereof, if desired.

The length of said faced portion 3 in its lateral direction should be arranged so as to be somewhat longer than that of a diameter of the ball 6 and the height of the portion 3 in the vertical direction, should be substantially half of the diameter of the ball so as to easily catch the ball at the center of the portion in the vertical direction in putting the ball into the hole.

The diameter of the circular hollow portion 2 of the head B preferably made of stainless steel in the shape of a ring composed of the portion 3 in part is arranged so as to be somewhat shorter than that of the ball 6. Thus, when the ball is pushed downward into the circular hollow portion 2 in a manner as described above, substantially a half portion of the ball may easily be pushed into said hollow portion so as to be maintained in position without dropping therefrom on account of the elasticity of the surface of the ball made of plastics with many dimples thereon and the friction between the ball and the peripheral edge of said hollow portion 2 abutting said surface of the ball. Along an inner peripheral surface 5 of said hollow portion 2, radial an overhanging thickened wall portion 4 having a thickness of 3–5 mm relative to the center of the opening of the club head is firmly secured to the inner peripheral surface 5 covering a portion corresponding substantially to two-thirds of the height of said surface 5 from the upper portion to the lower portion so as to maintain the ball pushed into the circular hollow portion 2. That is to say, lower curved portions of the ball can be maintained therein under a more stable condition owing to a step formed between said thickened wall portion 4 and inner peripheral surface 5.

Figure 3:
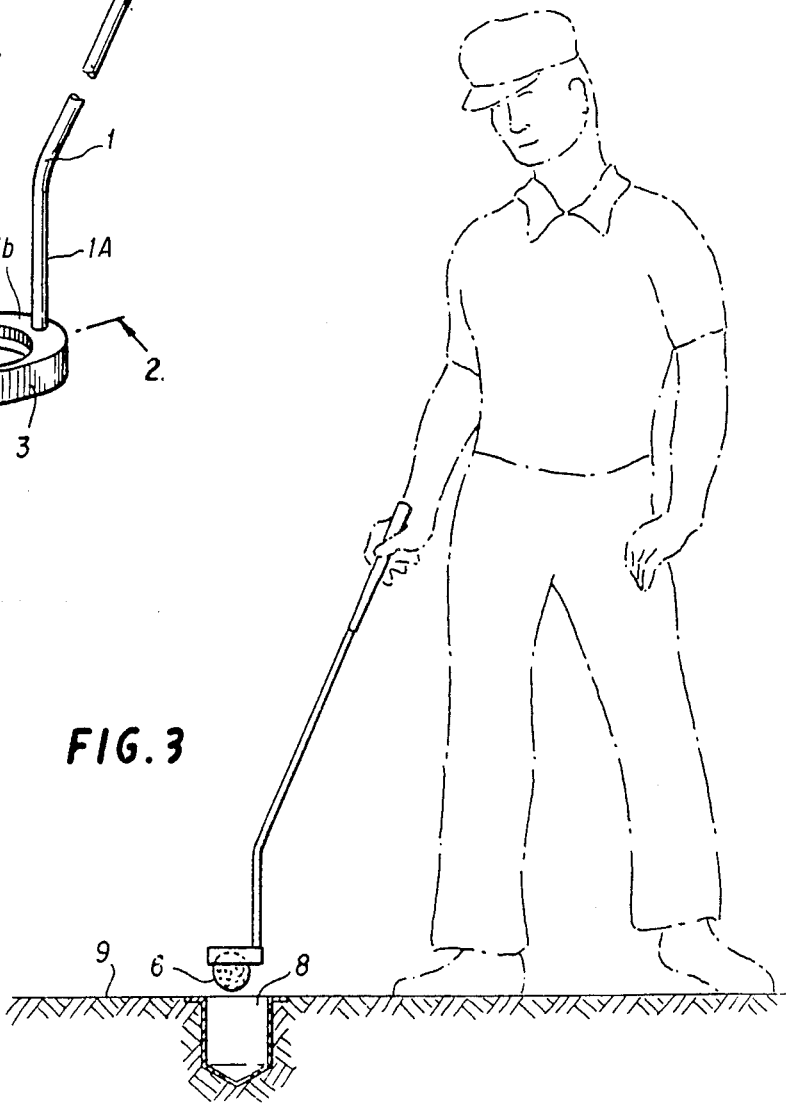
FIG. 3 is a reference view showing a mode of use of said putter.
Figure 4:
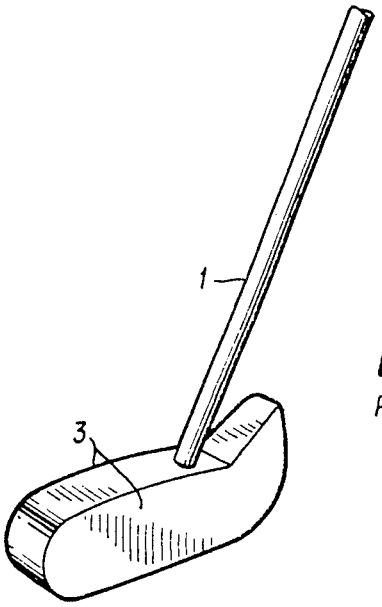
FIG. 4 PRIOR ART
FIG. 4 is a perspective view of a conventional putter.
Figure 5:
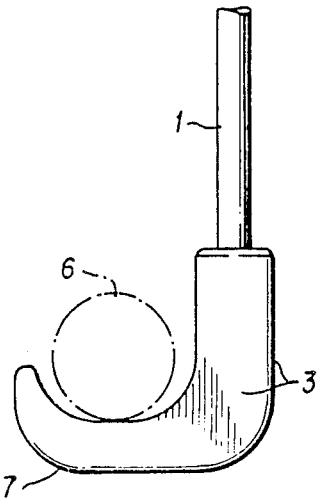
FIG. 5 PRIOR ART
FIG. 5 is a side view thereof.

Said thickened wall portion can be formed integrally with said inner peripheral surface 5 by employing the same material as that of the head or elastic steel having the thickness 3–5 mm in the shape of a band can also be secured to said inner peripheral face. FIG. 3 is a referencial view showing a mode of use of the putter according to the present invention.

In picking up the ball within the hole by employing the putter A in a standing posture of a golfer, the ball within the hole is slightly pushed downward into the hollow portion 5 of the head B constituted as described above by holding the shaft 1 with one hand. By pushing the ball slightly downward, the surface of which is made of plastics with a number of dimples (not illustrated), into the circular hollow portion 2 of the head B by utilizing the weight of said head, the ball having a predetermined weight (45.93 gram and less) can easily be maintained within the hollow portion without dropping therefrom on account of the elasticity of the surface of the ball with a number of dimples and the friction between the ball and the inner peripheral edge abutting said surface of the ball. Thus, the ball can be picked up surely and easily from the hole only by lifting the shaft 1 with one hand of a golfer.

As described hereinabove, the advantages of the putter according to the present invention can be summarized as follows. It is possible to pick up the ball within the hole surely and easily in a standing posture of a golfer, so that the conventional defect can be solved and furthermore the bad influence on the body ascribable to assuming a forced posture, such as bending the body while stretching an arm downward in order to pick up the ball in the hole, is also solved. Of course, the putter is convenient to pick up a ball within the so-called out-of-bounds area of a golf course.

Obviously, numerous modifications and variations of the present invention are possible in light of the above teachings. It is therefore to be understood that within the scope of the appended claims, the invention may be practiced otherwise than as specifically described herein.

What is claimed is:

1. A golf putter, comprising:

a shaft having one end portion secured firmly to a head, said head including arc-shaped members extending from both ends of a flat faced ball-striking portion, an opening in the form of a circle extending upward from the hollow bottom and including a first predetermined diameter hollow portion having a first predetermined diameter extending upwardly to a junction with a integral thickened discontinuous vertical wall portion made of the same material as said head and being of a radius which is 3–5 mm less than said first diameter for forming a thickened wall portion for gripping a golf ball.

2. The putter according to claim 7 wherein a lateral length portion of said flat faced portion is larger than a golf ball.

3. The putter according to claim 1, wherein the height of said flat faced portion corresponds substantially to half the diameter of a golf ball.

4. The putter according to claim 1, wherein said thickened vertical wall portion is in the shape of a band fixed to said head.

* * * * *